US007000865B1

(12) United States Patent
Zollinger

(10) Patent No.: US 7,000,865 B1
(45) Date of Patent: Feb. 21, 2006

(54) SNAP-ON BALL TENSIONING DEVICE

(76) Inventor: Richard V. Zollinger, 10 Donald Rd., Cowpens, SC (US) 29330

( * ) Notice: Subject to any disclaimer, the term of this patent is extended or adjusted under 35 U.S.C. 154(b) by 20 days.

(21) Appl. No.: 10/650,411

(22) Filed: Aug. 28, 2003

(51) Int. Cl.
*B65H 59/24* (2006.01)

(52) U.S. Cl. ..... 242/419.5; 242/152.1; 248/218.4

(58) Field of Classification Search ..... 242/419, 242/419.5, 419.8, 129.8, 151, 152.1, 153, 242/131; 226/195; 66/146, 213; 139/194; 248/218.4, 219.4; 211/107
See application file for complete search history.

(56) References Cited

U.S. PATENT DOCUMENTS 3,905,210 A 9/1975 McCullough ..... 66/125 R
4,279,388 A * 7/1981 McBride, Jr. ..... 242/152.1
4,290,565 A * 9/1981 Smith ..... 242/152.1
RE31,024 E 9/1982 Zollinger ..... 242/152.1
5,820,050 A 10/1998 Zollinger ..... 242/152.1

* cited by examiner

*Primary Examiner*—Kathy Matecki
*Assistant Examiner*—Scott Haugland
(74) *Attorney, Agent, or Firm*—Kennedy Covington Lobdell & Hickman, LLP

(57) ABSTRACT

A snap-on ball tensioning device for attachment to a right-angled post having a ball tension portion through which a yarn is fed with a post engaging surface. A connecting portion projects integrally from the ball tension portion, and leg portion extends from the connecting portion with a post engaging surface parallel with the ball tension portion post engaging surface for engagement on a leg of the right-angled post. A retaining lip is formed at the outer end of the leg portion post engaging surface and a retaining rib projects from the leg portion at a spacing inwardly from the retaining lip, with the lip and rib serving to properly position and retain the device against lateral movement on the leg of the post.

3 Claims, 9 Drawing Sheets

SNAP-ON BALL TENSIONING DEVICE

BACKGROUND OF THE INVENTION

The present invention relates generally to a ball tensioning device that can be attached by snapping onto one leg of a right-angle post for guiding and tensioning a yarn as it travels through the device.

Ball tensioning devices are used to create a uniformity of tension in a traveling yarn as it is feeding to various types of components of textile manufacturing equipment. Typical examples of ball tensioning devices of this type are disclosed in Zollinger U.S. Reissue Pat. No. RE. 31,024 and in Zollinger U.S. Pat. No. 5,820,050. One location at which ball tension devices have been located is on upstanding right-angle posts of creels on which multiple packages of supply yarn are mounted for feeding to a textile machine, such as a tufting machine or any other textile machine that draws yarn from a creel.

A ball tensioning device mounted on a right-angle post for tensioning and guiding yarn from a creel to a knitting machine is disclosed in McCullough U.S. Pat. No. 3,905,210. In this unit the ball tension device is attached by a screw to a separate support bracket. The bracket has a body portion that engages the outer surface of one leg of the post and extends outwardly therefrom to form a mounting for the ball tension device. Extending from the body is a leg portion that extends over the inner surface of the leg of the post. A stop portion projects from the end of the body portion beyond the end of the leg for engagement against the outer surface of the other leg of the post to prevent the bracket from sliding off the post. The bracket is made of resilient material so that the leg portion and body portion can be separated to allow snapping of the bracket onto the post. The bracket is formed with a thickened portion for attaching an supporting the ball tensioning device on the bracket at a spacing from the post.

SUMMARY OF THE INVENTION

The snap-on ball tensioning device of the present invention is an improvement over the combination of ball tensioning unit and bracket disclosed in the aforesaid McCullough U.S. Pat. No. 3,905,210. Rather than having separate ball tensioning unit and bracket connected by a screw mounting with the ball tensioning unit spaced from the post, the present invention provides an integral ball tensioning portion and bracket portion that can be simply and inexpensively produced and can be compactly mounted on a right-angle post with the ball tensioning portion being primarily inside the confines of the post and also having one of the post engaging surfaces formed thereon.

Basically, the snap-on ball tensioning device of the present invention includes a ball tension portion having a yarn traversing chamber extending therethrough with an entry port at one end and an exit port at the other end, one of the ports being lower than the other, an annular ball seat in the lower port, and a yarn tensioning ball seated on the ball seat to apply a tensioning force to a yarn traveling through the chamber. The ball tension portion has a first post engaging surface for positioning against the inner surface of one leg of a right-angled post. A connecting portion is formed integral with the ball tension portion and projects from the first post engaging surface. A leg portion formed integral with the connecting portion extends from the connecting portion and has a second post engaging surface for positioning against the outer surface of the leg of the post and extends generally parallel with the first post engaging surface at a spacing at an outer end less than the thickness of the leg of the post. The device is resilient to allow flexing of the leg portion away from the first post engaging surface to permit snapping of the device onto the leg of the post with the ball tension at the inner surface of the leg out of the way of accidental contact by another object.

In the preferred embodiment, the leg portion has an outer end formed with a retaining lip projecting toward the second post engaging surface at an outer spacing therefrom for engaging the outer surface of the other leg of the post to retain the ball tension portion on the post. An inner retaining rib projects from one of the post engaging surfaces toward the other post engaging surface and is spaced from the retaining lip a distance sufficient to position the leg of the post therebetween. This inner retaining rib is spaced laterally from the connecting portion toward the lip so that the rib does not interfere with the flexing.

Further areas of applicability of the present invention will become apparent from the detailed description provided hereinafter. It should be understood that the detailed description, while indicating the preferred embodiment of the invention, is intended for purposes of illustration only and is not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

The present invention will now be described fully hereinafter with reference to the accompanying drawing, in which the preferred embodiment of the present invention is shown. This invention may, however, be embodied in many different forms and should not be considered as limited to the embodiments set forth herein. Rather, this embodiment is provided so that the disclosure will be thorough and complete, and will fully convey the scope of the invention to those skilled in the art. It will be understood that all alternatives, modifications, and equivalents are intended to be included within the spirit and scope of the invention as defined by the appended claims.

Figure 1:
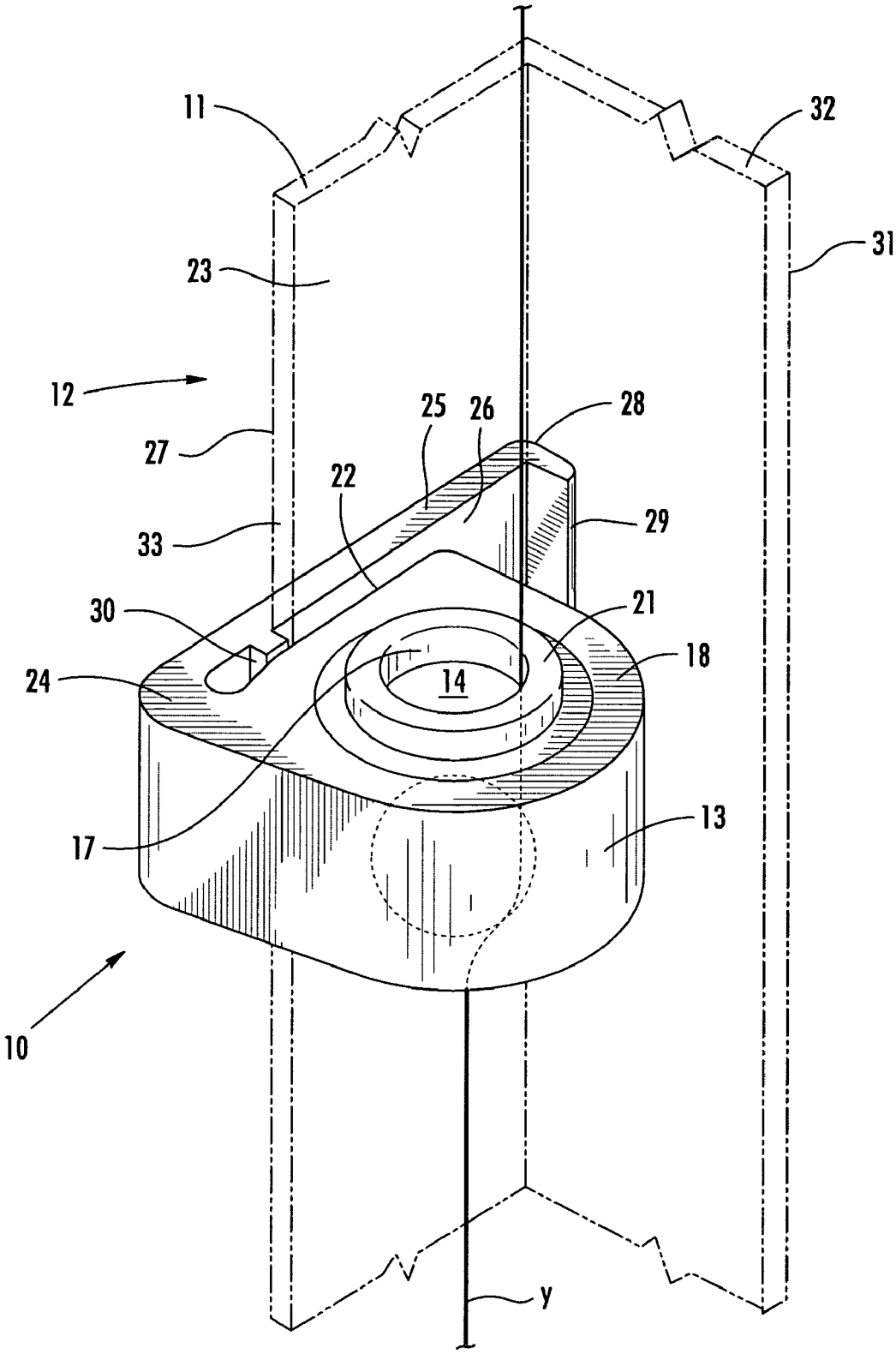
FIG. 1 is a perspective view of the snap-on ball tensioning device of the preferred embodiment of the present invention shown mounted on a right-angle post.
Figure 2:
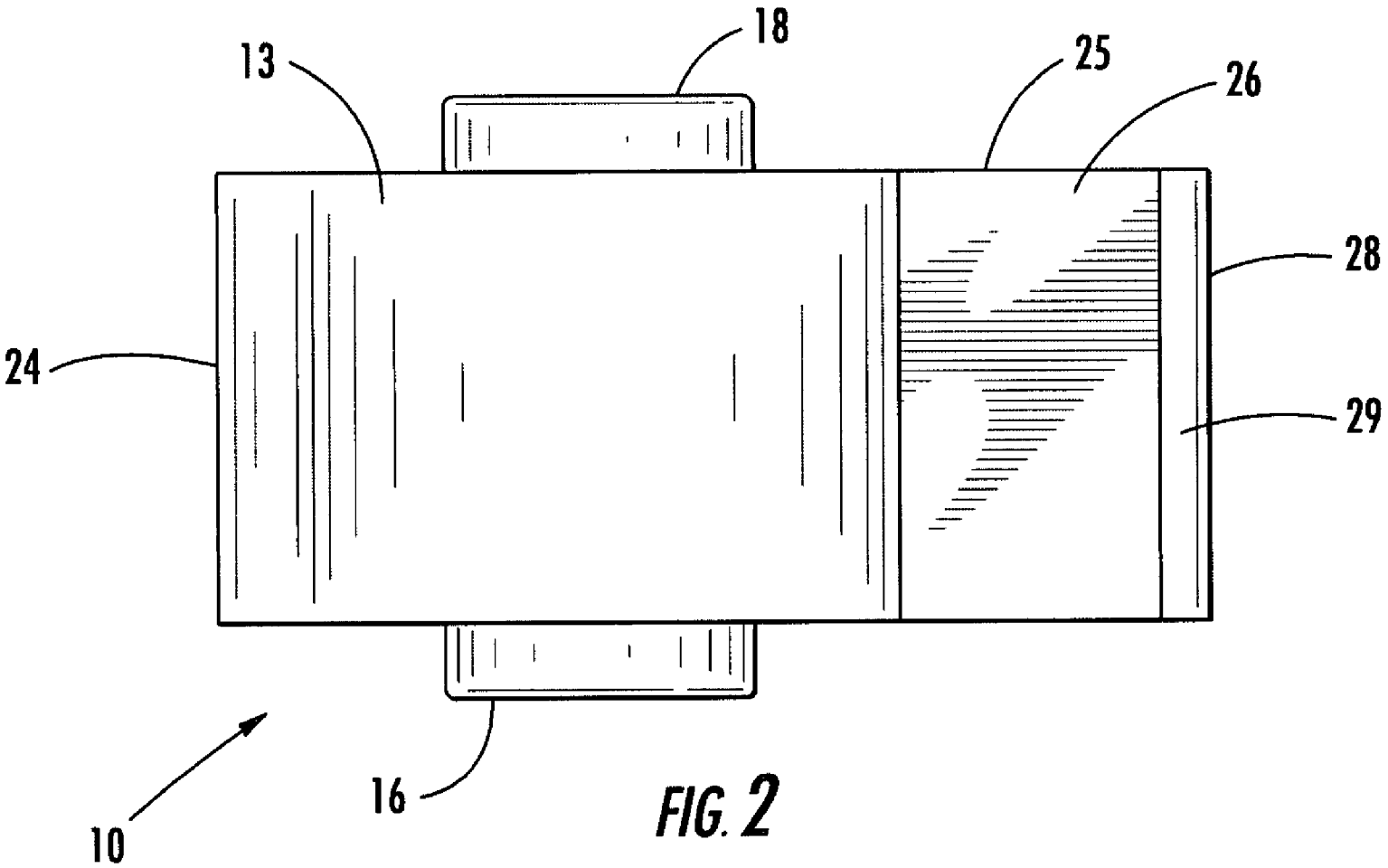
FIG. 2 is a front elevation of the device of FIG. 1 as viewed from the right in FIG. 1.
Figure 3:
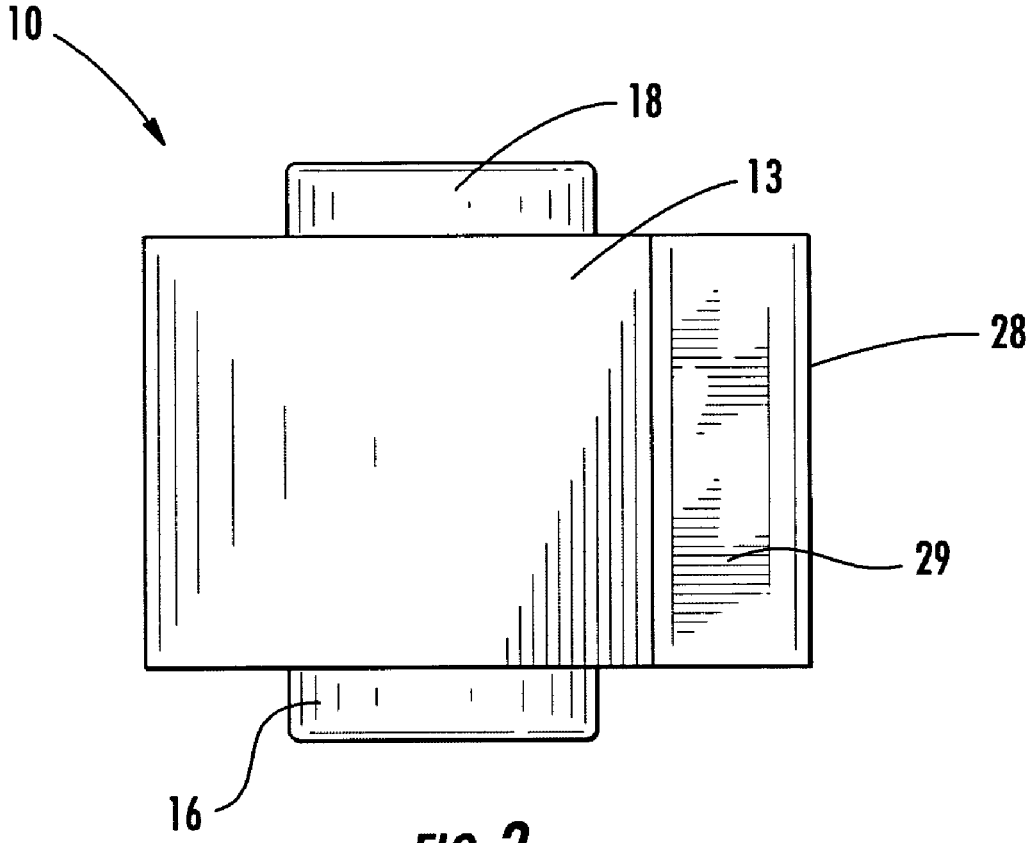
FIG. 3 is a side elevation of the device of FIG. 1 as viewed from the back of FIG. 1.
Figure 4:
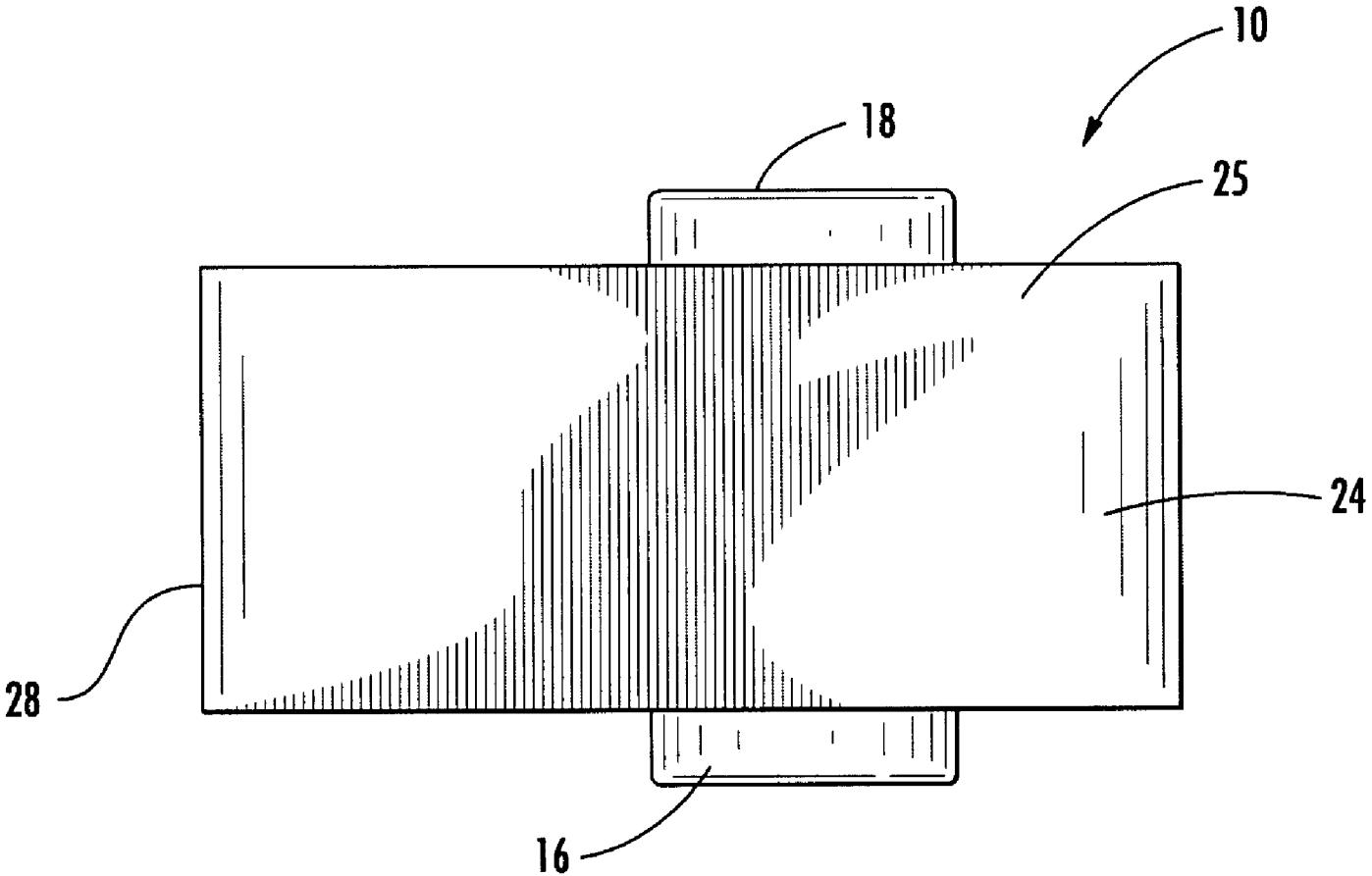
FIG. 4 is a rear elevation of the device of FIG. 1 as viewed from the left in FIG. 1.
Figure 5:
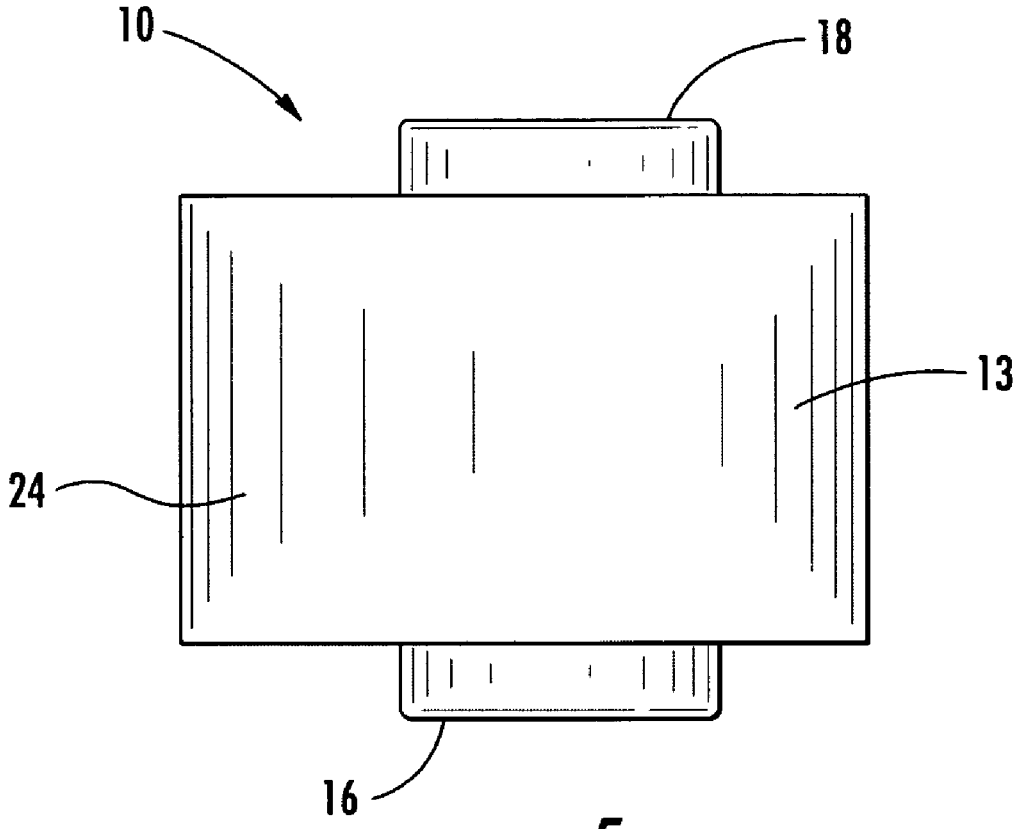
FIG. 5 is an end elevation of the device of FIG. 1 as viewed from the front of FIG. 1.

The snap-on ball tensioning device 10 of the preferred embodiment of the present invention is illustrated in FIG. 1. It is mounted on one leg 11 of a vertical post 12, which may be a vertical post of a yarn creel from which yarns are fed from supply packages to textile machines, such as tufting machines. The invention has applicability as well to other textile machines where a support, such as a right-angle post, is available for mounting of a ball tensioning unit.

The device 10 includes a ball tension portion 13 having a generally vertically extending chamber 14 therethrough. The chamber 14 has an entry port 15 at the lower end 16 of the ball tension portion 13 and an exit port 17 at the upper end 18 of the ball tension portion 13. A ball seat 19 is mounted in the entry port 15 and a ball 20 is seated on the ball seat 19. A cap 21 is mounted in the exit port 17. With this arrangement a yarn Y feeds upwardly through the entry port past the ball 20 and through the exit port 17, with the ball exerting a force on the traveling yarn Y that effects a uniform tensioning of the yarn as it exits the device 10, smoothing out any variations in tension of the yarn as it feeds from the yarn supply packages or other source.

The ball tension portion 13 is formed with a first post engaging surface 22 extending generally parallel with the chamber 14 and disposed for positioning against the inner surface 23 of the leg 11 of the post.

A connecting portion 24 is formed integral with the ball tension portion 13 and projects from the first post engaging surface 22 for connecting with an integral leg portion 25 that extends from the connecting portion 24 to provide a second post engaging surface 26 for positioning against the outer surface 27 of the leg 11 of the post 12. The second post engaging surface 26 extends generally parallel with the first post engaging surface 22 at a spacing at its outer end 28 less than the thickness of the leg 11 of the post 12. With the exception of the ball seat 19, ball 20 and cap 21, the tensioning device is formed integrally of resilient material, preferably any suitable resilient plastic having sufficient rigidity to retain the device 10 on the post 12. The resiliency, particularly the resiliency of the connecting portion 24 allows the surface engaging portions 22 and 25 to be flexed open for insertion over the leg 11 of the post 12 and the resiliency urges the surfaces 22 and 26 toward each other sufficiently to be snapped on the leg 11 of the post 12 and stay in a suitably selected location.

The ball tension portion 13, having the first post engaging surface 22 formed thereon is, by this arrangement, disposed compactly within the confines of the legs of the post 12 out of the path of possible inadvertent contact by a person or by some object.

The leg portion 25 extends outwardly beyond the ball tension portion 13 in the direction of the post 12 and has an outer end 28 at which a retaining lip 29 is formed. This retaining lip 29 projects in the direction of the ball tension portion 13 to be positioned around the corner of the post 12 to engage the outer surface 31 of the other leg 32 of the post 12 to retain the device 10 on the post 12 against lateral removal.

A retaining rib 30 is also formed on the leg portion 25. This rib 30 is space inwardly from the retaining lip 29 a distance approximately equivalent to or slightly greater than the width of the leg 11 of the post 12, thereby cooperating with the lip 29 to retain the device 10 in proper position on the post 12.

The retaining rib 30 is spaced from the connecting portion 24 toward the retaining lip 29 so as not to interfere with flexing of the leg portion 25 through the connecting potion 24.

Figure 6:
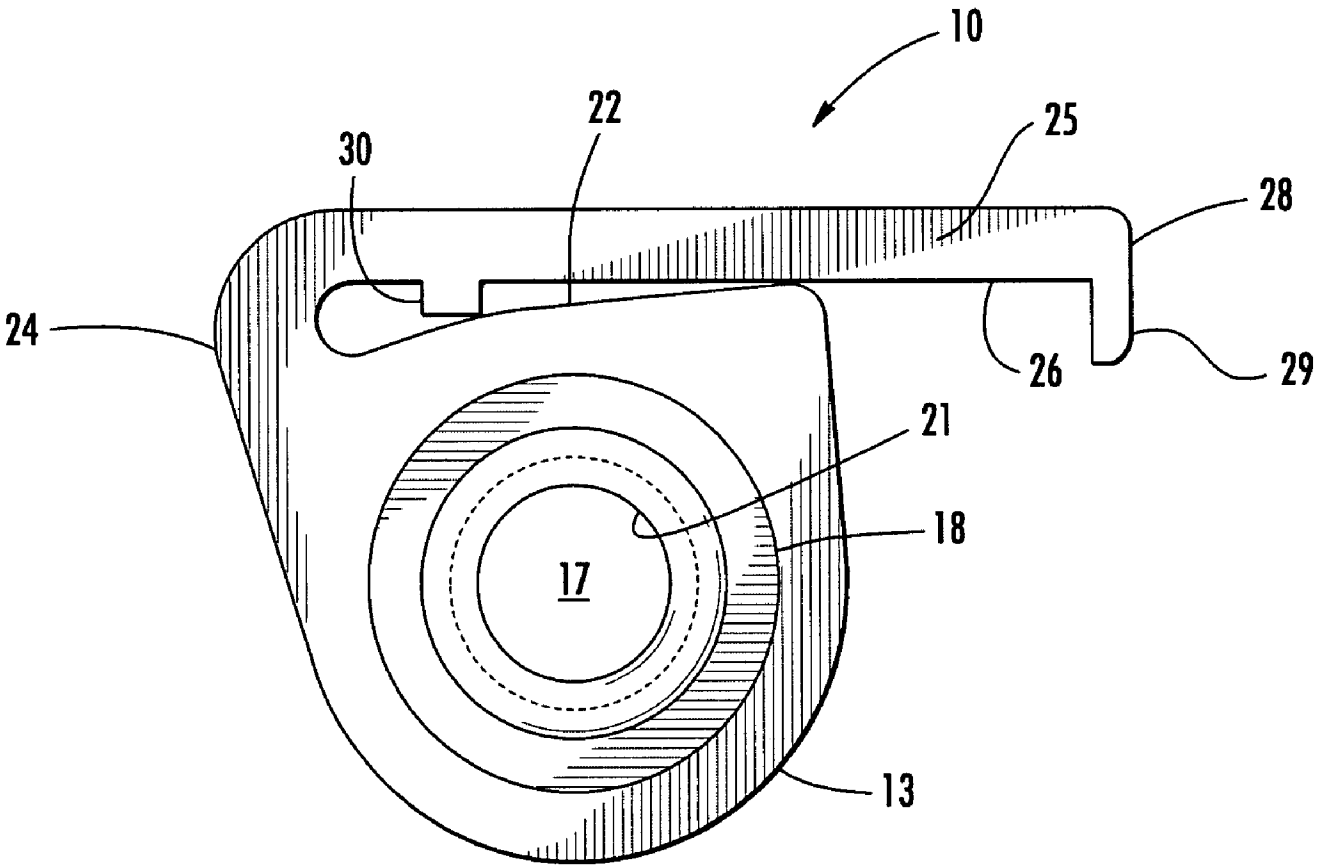
FIG. 6 is a plan view of the device of FIG. 1 before it is attached to a post.
Figure 7:
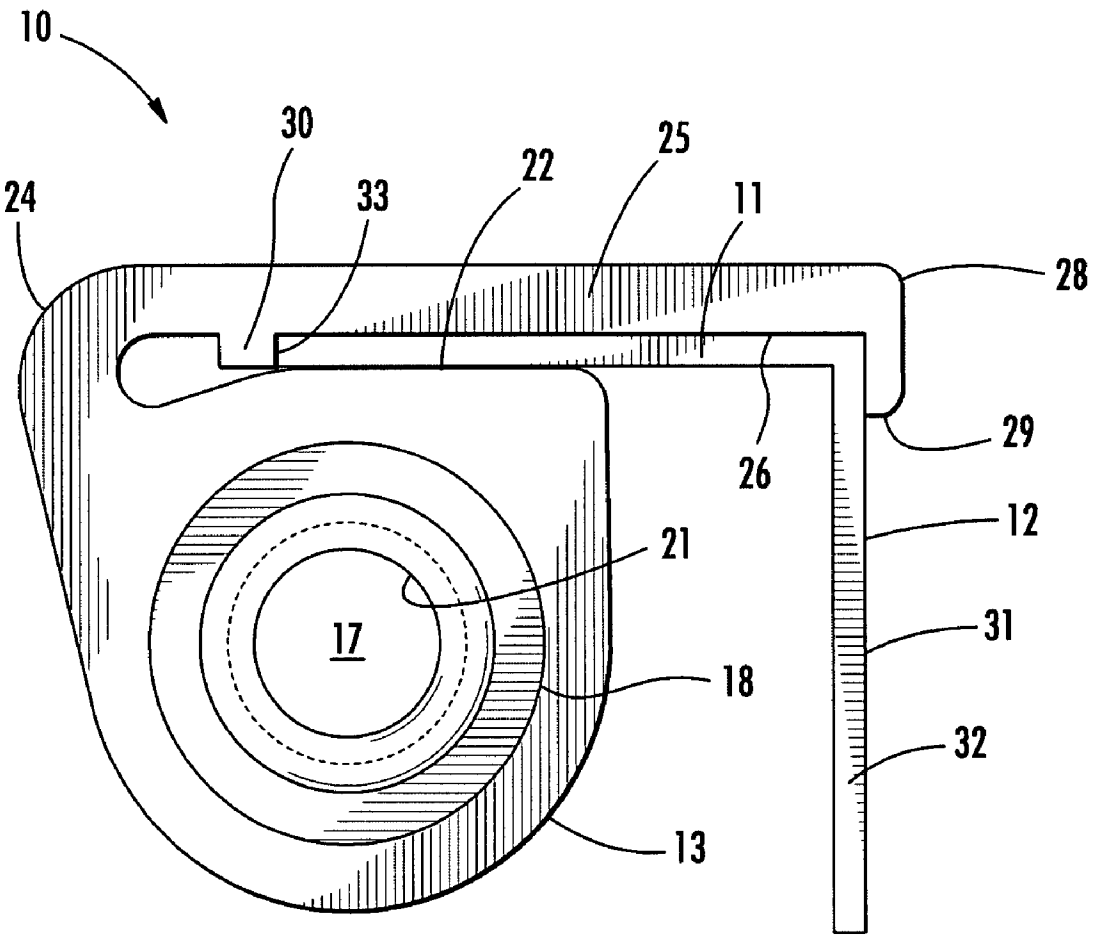
FIG. 7 is a plan view of the device of FIG. 1 shown mounted on a right-angle post.
Figure 8:
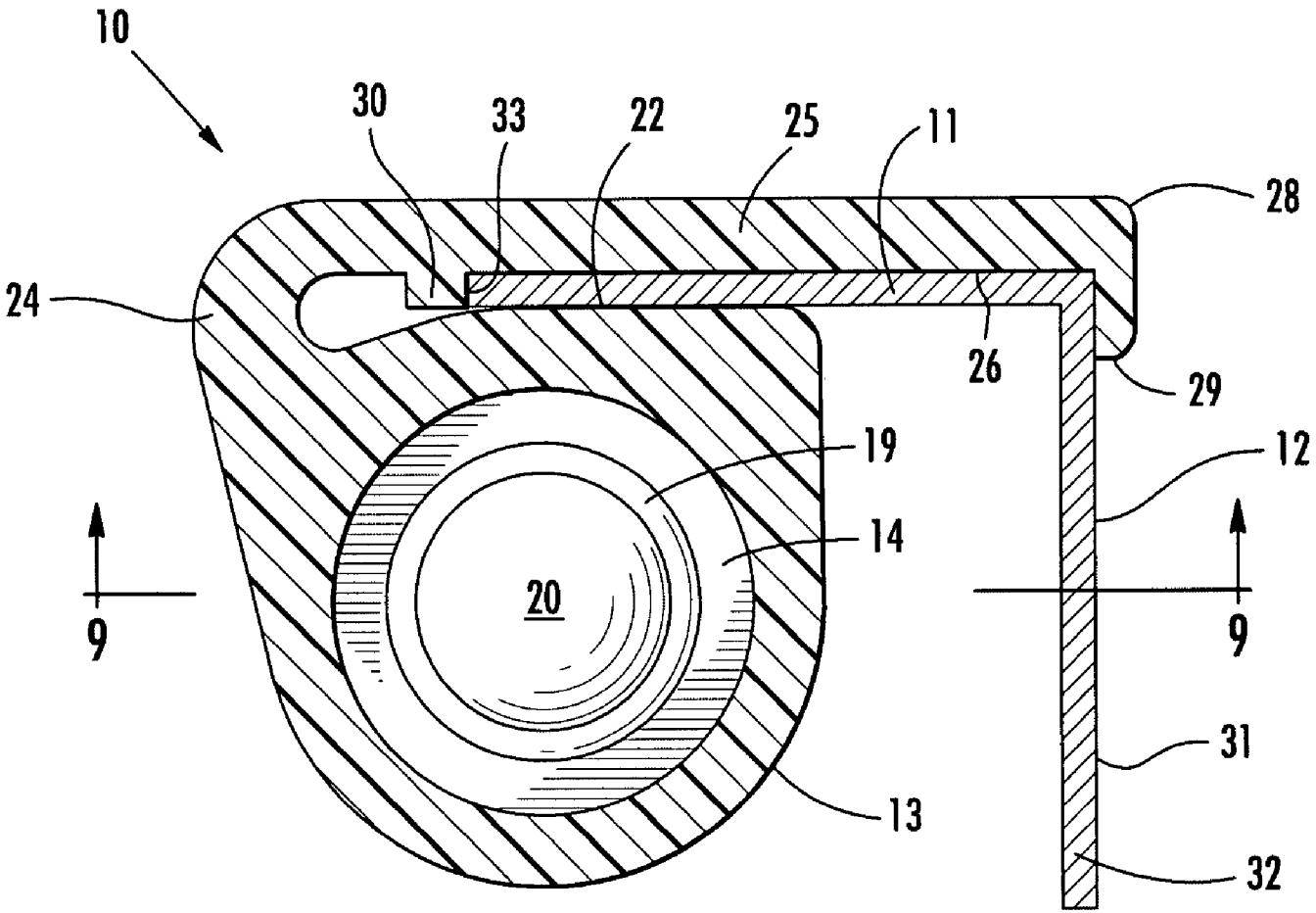
FIG. 8 is a horizontal sectional view taken through the device and post illustrated in FIG. 7.
Figure 9:
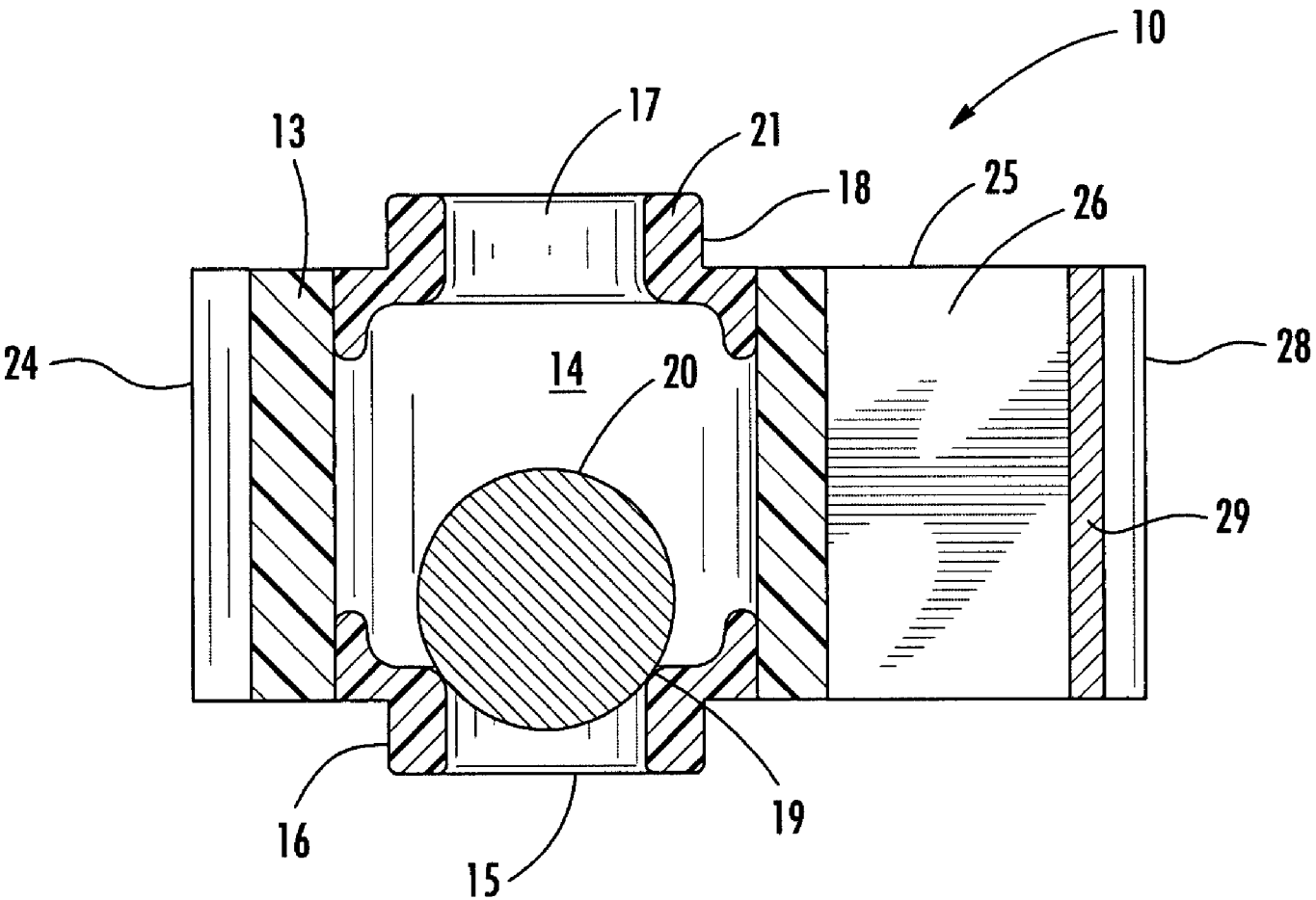
FIG. 9 is a vertical sectional view taken along line 9—9 in FIG. 8.

In use, the ball tensioning device 10, before it is mounted on a post 12, has its leg portion 25 resiliently urged against the ball tension portion 13, as illustrated in FIG. 6. To mount it on the post 12, the leg portion 25 is resiliently spread apart from the ball tension portion 13 against the resilience of the connecting portion 24. This spreading is sufficient to allow the retaining lip 29 to slide along the outer surface 27 of the leg 11 of the post 12 and the post engaging surface 22 of the ball tension portion 13 to slide along the inner surface 23 of the leg 11 until the retaining lip 29 snaps over the inner end of the leg 11 and engages the outer surface 31 of the other leg 32 of the post 12, with the retaining rib 30 stopping against the outer edge 33 of the leg 11, as illustrated in FIG. 7.

From the above description, it is apparent that the present invention provides a ball tension portion integrally formed with the mounting bracket portion in a compact, inexpensive construction with the ball tension portion 13 conveniently and effectively located within the confines of the post, and, thus, in a location protected from inadvertent contact by some outside object.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A snap-on ball tensioning device for attachment to a right-angle post comprising:

a ball tension portion having a yarn traversing chamber extending therethrough with an entry port at one end and an exit port at the other end, one of said ports being lower than the other, an annular ball seat in said lower port, and a yarn tensioning ball seated on said ball seat to apply a tensioning force to a yarn traveling through said chamber, said ball tension portion having a first post engaging surface for positioning against the inner surface of one leg of the right-angle post;

a connecting portion formed integral with said ball tension portion and projecting from said first post engaging surface;

a leg portion formed integral with said connecting portion extending from said connecting portion and having a second post engaging surface for positioning against the outer surface of said one leg of said post and extending generally parallel with said first post engaging surface at a spacing at an outer end less than the thickness of the one leg of the post;

said portions being sufficiently resilient to allow flexing of said leg portion away from said first post engaging surface to permit snapping of said device onto the one leg of a post with said ball tension portion at the inner surface of the one leg of the post;

said leg portion has an outer end formed with a retaining lip projecting toward said second post engaging surface at an outward spacing therefrom for engaging the outer surface of the other leg of the post to retain said ball tensioning portion on the post; and an inner retaining rib projecting from one of said post engaging surfaces toward the other post engaging surface and spaced from said retaining lip a distance sufficient to position the one leg of the post therebetween.

2. A ball tensioning device according to claim 1 and characterized further in that said inner retaining rib is spaced laterally from said connecting portion toward said lip.

3. A ball tensioning device according to claim 1 and characterization further in that said retaining ribs projects integrally from said leg portion.

* * * * *